US008375878B1

(12) United States Patent
Shivers, III et al.

(10) Patent No.: US 8,375,878 B1
(45) Date of Patent: Feb. 19, 2013

(54) METHOD FOR OFFLOADING A FLUID THAT FORMS A HYDROCARBON VAPOR USING A SOFT YOKE

(75) Inventors: Robert Magee Shivers, III, Houston, TX (US); William T. Bennett, Jr., Houston, TX (US); David Trent, Houston, TX (US)

(73) Assignee: ATP Oil & Gas Corporation, Houston, TX (US)

( * ) Notice: Subject to any disclaimer, the term of this patent is extended or adjusted under 35 U.S.C. 154(b) by 190 days.

(21) Appl. No.: 13/025,604

(22) Filed: Feb. 11, 2011

(51) Int. Cl.
*E02B 3/24* (2006.01)

(52) U.S. Cl. ..... 114/230.17

(58) Field of Classification Search ..... 114/362, 114/230.15, 230.17
See application file for complete search history.

(56) References Cited

U.S. PATENT DOCUMENTS 3,155,069 A * 11/1964 Ross et al. ..... 114/230.19
4,003,473 A * 1/1977 Ryan ..... 14/71.7
4,041,721 A * 8/1977 Kniel ..... 62/53.2
4,315,533 A * 2/1982 Eagles ..... 141/387
4,359,959 A * 11/1982 Delamare ..... 114/230.15
4,494,475 A * 1/1985 Eriksen ..... 114/230.14
4,543,070 A * 9/1985 Olsen et al. ..... 441/5
4,735,167 A * 4/1988 White et al. ..... 114/230.14
5,927,225 A * 7/1999 Jeter et al. ..... 114/230.1
7,107,925 B2 * 9/2006 Wille et al. ..... 114/230.15
8,100,076 B1 * 1/2012 Shivers et al. ..... 114/230.14
8,104,416 B1 * 1/2012 Shivers et al. ..... 114/230.14
2007/0095427 A1 * 5/2007 Ehrhardt et al. ..... 141/387
2011/0182698 A1 * 7/2011 Foo et al. ..... 414/137.5
2011/0232767 A1 * 9/2011 Liem et al. ..... 137/1

* cited by examiner

*Primary Examiner* — Stephen Avila
(74) *Attorney, Agent, or Firm* — Buskop Law Group, PC; Wendy Buskop

(57) ABSTRACT

A method for use in deep water, for dynamically connecting a fixed for floating vessel to a floating transport vessel using at least one telescoping mooring arm, and for flowing a fluid that forms a hydrocarbon vapor to the moveable floating transport vessel with offload flexible conduits that adjust to accommodate vessel motion, wave motion, current motion, and other weather motion without disengaging is disclosed herein. The method can include using telescoping mooring arms to maintain a nominal distance between the fixed or floating vessel and the transport vessel while forming an enclosed gangway. The method can include monitoring off-loading and return of hydrocarbon vapor, providing quick connect/disconnect engagements to the transport vessel, and using an adjustable vapor return flexible conduit. The method can include releasing the transport vessel from the fixed for floating vessel to transport the fluid to another location.

12 Claims, 15 Drawing Sheets

FIGURE 10A

FLOWING THE FLUID THAT PRODUCES A HYDROCARBON VAPOR FROM THE FIXED OR FLOATING VESSEL TO THE MOVEABLE FLOATING TRANSPORT VESSEL USING AT LEAST ONE TELESCOPING MOORING ARM HAVING CONNECTED THERETO AT LEAST ONE OFFLOAD FLEXIBLE CONDUIT FOR FLOWING THE FLUID — 600

ADJUSTING THE AT LEAST ONE OFFLOAD FLEXIBLE CONDUIT TO ACCOMMODATE FIXED OR FLOATING VESSEL MOTION, MOVEABLE FLOATING TRANSPORT VESSEL MOTION, WAVE MOTION, CURRENT MOTION, AND OTHER WEATHER MOTION WITHOUT DISENGAGING — 602

SIMULTANEOUSLY AND DYNAMICALLY USING A SLIDING ENGAGEMENT BETWEEN A JIB NESTED IN A BOOM TO CONNECT THE FIXED OR FLOATING VESSEL TO THE MOVEABLE FLOATING TRANSPORT VESSEL DURING OFFLOADING OF THE FLUID — 604

FORMING A TELESCOPING AND DYNAMICALLY MOVING ENCLOSED GANGWAY TO SAFELY TRANSPORT PERSONNEL AND EQUIPMENT BETWEEN THE MOVEABLE FLOATING TRANSPORT VESSEL AND THE FIXED OR FLOATING VESSEL — 605

MONITORING WHILE OFFLOADING AND RETURNING THE HYDROCARBON VAPOR FROM THE MOVEABLE FLOATING TRANSPORT VESSEL DURING OFFLOADING OF THE FLUID — 606

ACCOMMODATING MOVEABLE FLOATING TRANSPORT VESSELS WITH A VARIETY OF STERN CONFIGURATIONS — 608

PROVIDING CONNECT/DISCONNECT ENGAGEMENTS AND AT LEAST ONE EMERGENCY DISCONNECT ENGAGEMENT BETWEEN THE FIXED OR FLOATING VESSEL AND THE MOVEABLE FLOATING TRANSPORT VESSEL FOR FAST CONNECT AND FAST DISENGAGEMENT IN CASE OF STORMS, ROGUE WAVES, OR A FIRE — 610

RECYCLING THE HYDROCARBON VAPOR TO THE FIXED OR FLOATING VESSEL USING A VAPOR RETURN FLEXIBLE CONDUIT, AND MAINTAINING A CRYOGENIC TEMPERATURE USING A FLOW RATE SUBSTANTIALLY THE SAME AS A RATE AT WHICH THE FIXED OR FLOATING VESSEL USES FUEL — 611

TRANSPORTING THE FLUID IN THE OFFLOAD FLEXIBLE CONDUIT AT A CRYOGENIC TEMPERATURE OF COLDER THAN -262 DEGREES FAHRENHEIT USING A FLOW RATE SUBSTANTIALLY THE SAME AS THE RATE AT WHICH THE FIXED OR FLOATING VESSEL USES FUEL — 612

USING AN ACCUMULATOR TO MANAGE PRESSURE IN A CYLINDER USED TO CONTROL THE SLIDING ENGAGEMENT BETWEEN THE JIB AND THE BOOM FOR MAINTAINING A DISTANCE BETWEEN THE MOVEABLE FLOATING TRANSPORT VESSEL AND THE FIXED OR FLOATING VESSEL AT A PRESET DISTANCE — 614

10B

METHOD FOR OFFLOADING A FLUID THAT FORMS A HYDROCARBON VAPOR USING A SOFT YOKE

FIELD

The present embodiments generally relate to a method for positioning a transport ship or vessel relative to a fixed or floating vessel, such as a floating structure or floating natural gas processing station, and offloading a fluid that can form a hydrocarbon vapor during offloading, such as a liquefied natural gas.

BACKGROUND

A need exists for a method for offshore transfer of fluid that can form a hydrocarbon vapor, while maintaining a stable distance between a fixed or floating vessel and a transport ship safely without creating emissions to the environment.

A need exists for a method that can be used to dynamically react to environmental conditions, such as wind and waves, to extend and retract a jib to maintain a stable distance between a fixed or floating vessel and the transport ship while offloading.

A need exists for a method for maintaining a nominal distance between the fixed or floating vessel and the transport ship, and providing a quick release and emergency disconnect without spilling any of the fluid into the sea when the jib has extended to a maximum extension or retracted to a minimum retraction.

A further need exists for a method that can safely transport personnel and equipment while floating in rough seas, while offloading a fluid that forms a hydrocarbon vapor, and while maintaining a transport ship at a nominal distance adjustably from the fixed or floating vessel.

The present embodiments meet these needs.

BRIEF DESCRIPTION OF THE DRAWINGS

The detailed description will be better understood in conjunction with the accompanying drawings as follows:

FIGS. 10A-10B depict another embodiment of the method.

Figure 1A:
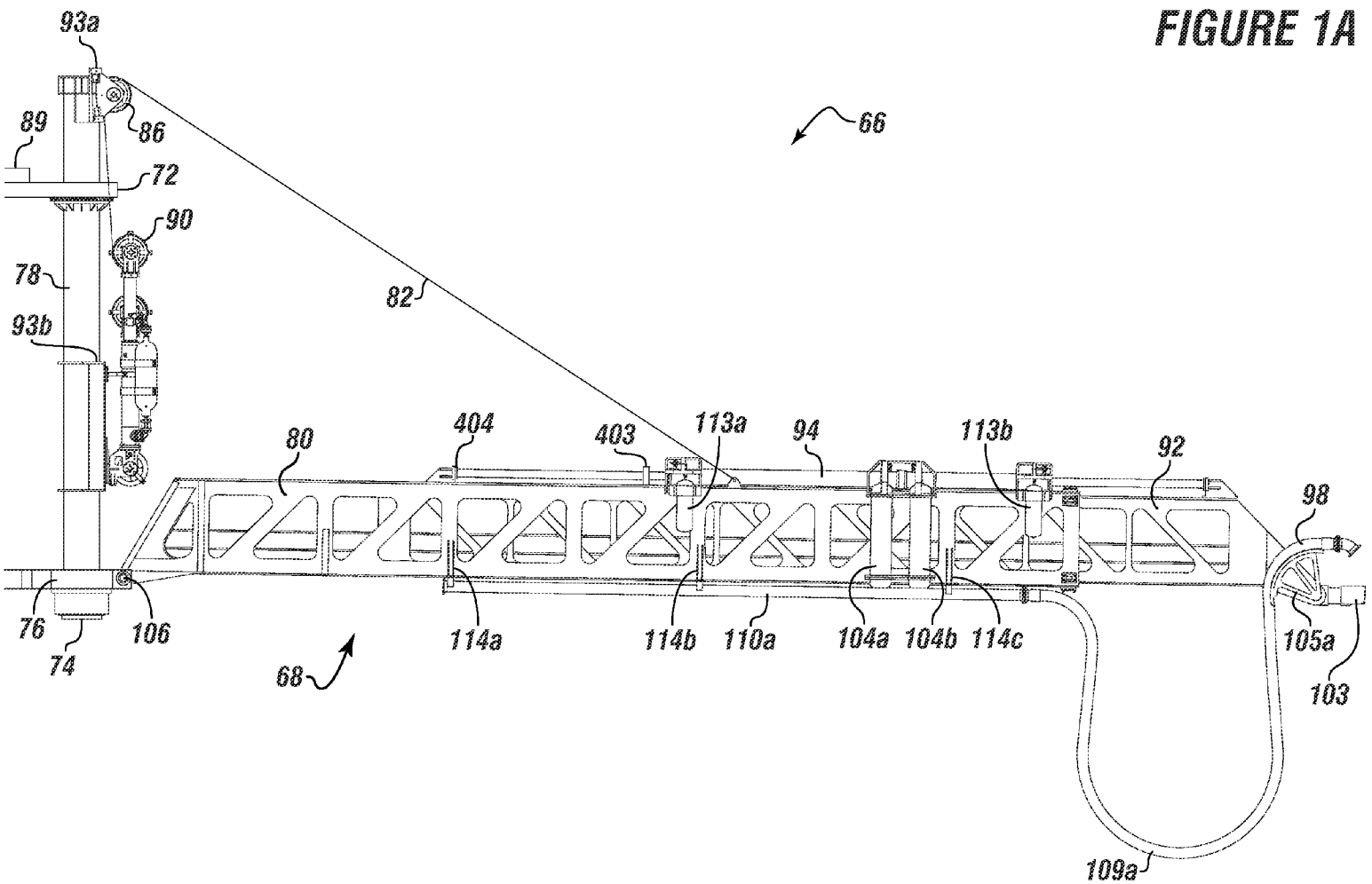
FIG. 1A depicts a first side view of a soft yoke with a boom in a second position for use on a floating station to maintain a transport vessel apart from the floating station.

The present embodiments are detailed below with reference to the listed Figures.

DETAILED DESCRIPTION OF THE EMBODIMENTS

Before explaining the present method in detail, it is to be understood that the method is not limited to the particular embodiments and that it can be practiced or carried out in various ways.

The present embodiments generally relate to a method for offloading a fluid that provides a hydrocarbon vapor.

The method can be used in deep water and with liquefied natural gas which can be kept at cryogenic temperatures. The method can be used in water, such as water at a depth of about 200 feet or deeper.

The method can allow offloading of fluids, such as liquefied natural gas to a transport ship, such as a moveable floating transport vessel, using offload flexible conduits that can be adjusted to accommodate transport vessel motion, wave motion, current motion, wind motion, changes in draft, or other motions without disengaging. For example, telescoping mooring arms can be used to maintain a nominal distance between the fixed or floating vessel and the transport vessel, while simultaneously forming an enclosed gangway and monitoring offloading and return of hydrocarbon vapor.

The method can include providing quick connect/disconnect engagements between the fixed or floating vessel and the transport vessel.

The method can include recycling hydrocarbon vapor formed during offloading of the liquid to the station using adjustable vapor return flexible conduits, and maintaining a cryogenic temperature.

The method can include releasing the transport vessel from the fixed or floating vessel, and transporting the fluid to another location using the transport vessel.

The method can be a moveable and relocatable method designed to operate in open sea conditions. The method can be used to flow 200 million standard cubic feet of liquefied natural gas per day, or another amount of fluid.

The method can include maintaining the fluid, such as liquefied natural gas, at a cryogenically cold temperature, such as at a temperature of −262 degrees Fahrenheit.

The method can include using a soft yoke in to flexibly and moveably connect the transport vessel to the fixed or floating platform or vessel, which can be a floating liquefied natural gas processing station.

The method can include using at least one telescoping mooring arm of the soft yoke to flexibly and moveably connect the transport vessel to the fixed or floating vessel. Each telescoping mooring arm can have a boom and jib configuration that can be nested together, allowing the telescoping mooring arms to slide in and out as the transport vessel and/or the fixed or floating vessel pitches, yaws, rolls, surges, sways, and heaves. The dimensions of the jib can be from about 7 feet to about 14 feet wide, and from about 50 feet to about 100 feet long.

The method can include flexibly transferring the fluid that forms a hydrocarbon vapor, such as a liquefied natural gas, from the fixed or floating vessel to the transport vessel, and transferring formed hydrocarbon vapor from the transport vessel to the fixed or floating vessel. The hydrocarbon vapor can then be used as a fuel and/or can be recycled through a station heat exchanger with a liquefaction train on the fixed or floating vessel. The liquefaction train can be a dual expansion nitrogen cycle assembly, another natural gas liquefaction train, a single mixed refrigerant, a dual mixed refrigerant, or a cascade refrigerant. The transport vessel can be a ship with a hull, stern, and bow.

The method can include simultaneously and safely providing for the transport of people and equipment between the fixed or floating vessel and the transport vessel, such as in the open sea during calm weather or during gale and 100 year storm conditions, without the people or equipment falling into the sea.

The method can include providing a means for collapsing or retracting the telescoping mooring arms, such that the floating or fixed vessel can be towed or moved without the telescoping mooring arms projecting outwards, thereby enabling the floating or fixed vessel to safely be maneuvered under or between bridges from yards.

The method can include recycling the hydrocarbon vapor from storage tanks on the transport vessel back to the fixed or floating vessel, such as by using the telescoping mooring arms. The rate of return of the hydrocarbon vapor to the fixed or floating vessel can be the same rate as the flow rate the offloading of the fluid from the fixed or floating vessel.

The telescoping mooring arms can each have a length from about 50 feet to about 150 feet, and a width from about 7 feet to about 14 feet. However, the size of the soft yoke can be different depending upon the particular application. In one or more embodiments, a stiffness of the telescoping mooring arms can operate within a range from about 2.5 tons per foot to about 10 tons per foot.

The method can include using a quick release and quick connect. To accomplish this, the method can include using three connectors including: a primary quick connect/disconnect connector, a secondary emergency disconnect connector, and a tertiary disconnect connector.

The method can include using pressurized cylinders and an accumulator in order to continuously and systematically centralize the boom with the jib of the soft yoke.

Each soft yoke mooring arm can have a yoke vapor return flexible conduit for communicating hydrocarbon vapor formed during offloading of the fluid back to the fixed or floating vessel for use in running portions of the fixed or floating vessel.

For example, during the flowing of the fluid to storage tanks on the transport vessel, certain fluids, such as liquefied natural gas, can form a vapor. The yoke vapor return flexible conduit can receive the formed vapor and flow the formed vapor from the transport vessel to the fixed or floating vessel, such as for processing or for use as a fuel. The formed vapor can be reprocessed, such as with a station heat exchanger, and can flow back through the yoke offload flexible conduit to the transport vessel.

The method can include transporting personnel and equipment over an enclosed gangway formed by nesting the jib in the boom. The enclosed gangway can have openings. The enclosed gangway can support movement of personnel and equipment up to 800 pounds.

The method can include using the telescoping mooring arms to maintain the transport vessel at a distance from the fixed or floating vessel. The distance can be any length required to maintain a predefined distance between the transport vessel, such as a ship, and the floating or fixed vessel. For example, the predefined distance, or "nominal distance", can range from +/−5 feet to +/−30 feet.

The method can include using at least one controller to cause dynamic positioning and control of the distance between the fixed or floating vessel and the transport vessel, and/or a location of the transport vessel relative to a preset longitude and latitude.

Figure 1B:
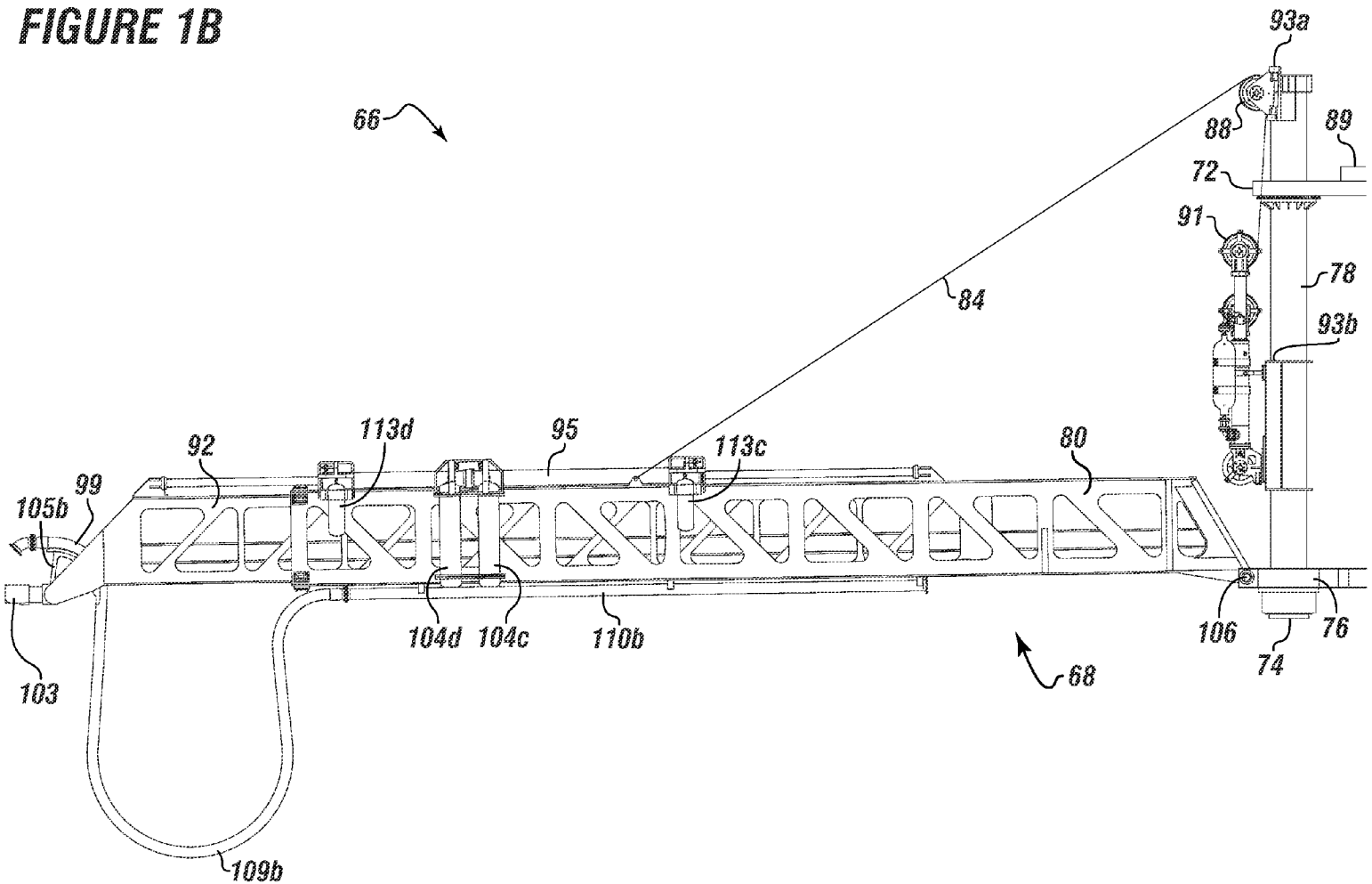
FIG. 1B shows a second side view of the soft yoke with the boom in the second position.

FIG. 1A depicts a side view of a soft yoke 66 with a first telescoping soft yoke mooring arm 68. FIG. 1B shows the opposite side of the soft yoke 66 shown in FIG. 1A.

Referring now to both FIGS. 1A and 1B, the first telescoping soft yoke mooring arm 68 can include an upper connecting mount 72 for engaging a floating natural gas processing station, a fixed or floating vessel, a floating structure, or the like.

The first telescoping soft yoke mooring arm 68 can include a lower connecting mount 74 for engaging the floating natural gas processing station, fixed or floating vessel, floating structure, or the like.

The upper connecting mount 72 and the lower connecting mount 74 can have a diameter from about 48 inches to about 84 inches, and can be made of powder coated steel.

The first telescoping soft yoke mooring arm 68 can be actuated by a soft yoke controller 89, which can be in communication with a station controller (shown in FIG. 3A), or the first telescoping soft yoke mooring arm 68 can be actuated by the station controller.

The soft yoke 66 can include a turn table 76 connected to the lower connecting mount 74. The dimensions of the turn table 76 can be from about 9 feet to about 12 feet in diameter. The turn table 76 can have a thickness from about 12 inches to about 24 inches, and can be made of steel with an internal bearing of bronze or another frictionless material.

The soft yoke 66 can include a king post 78 that engages with the turn table 76, the upper connecting mount 72, and the lower connecting mount 74. The turn table 76 can be configured to rotate with the king post 78. The king post 78 can be connected to a first tensioner 90 and a second tensioner 91 by a tensioner mount 93*b*.

The king post 78 can be made of steel, and can have a length of from about 12 feet to about 50 feet and a diameter from about 3 feet to about 6 feet. The king post 78 can be a rolled tube with a hollow portion.

The soft yoke 66 can have a boom 80 connected to the turn table 76. The boom 80 can have a length from about 40 feet to about 140 feet, a height from about 8 feet to about 14 feet, and a width from about 8 feet to about 16 feet.

In embodiments, the boom 80 can be a tubular. The boom 80 can have a diameter from about 14 feet to about 16 feet. The boom 80 can include hollow tubulars welded together to reduce cost in shipping. The boom 80 can be configured to not fail upon impacts and slams, which can occur to the floating natural gas processing station to which the boom 80 is attached. For example, the boom 80 can be configured to not fail upon impacts and slams during a 20 year storm, according the US Coast Guard classification of a 20 year storm with wave sizes of up to 12 feet and a frequency of from about 2 feet to about 3 feet.

A heel pin 106 can connect the boom 80 to the turn table 76, allowing the boom 80 to rotate relative to the turn table 76. A typical heel pin can be machined from cold drawn high strength steel shafting, and can have a length from about 6 inches to about 18 inches and a diameter from about 6 inches to about 12 inches. The boom 80 can be locked into the turn table 76 using a collet and locking pin.

Figure 1C:
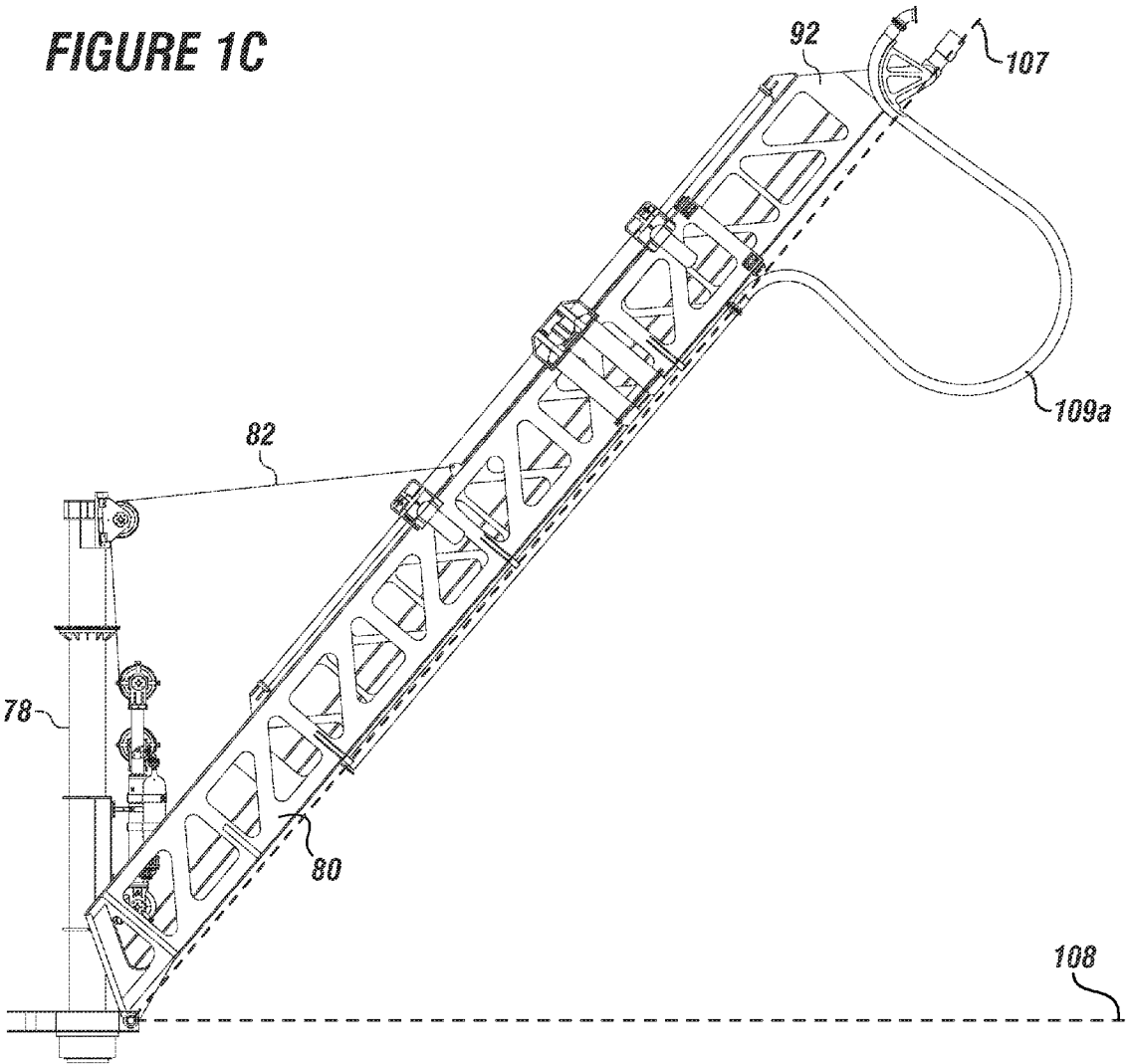
FIG. 1C shows a side view of the soft yoke in a first retracted position.

As such, the boom 80 can pivot from a first position, such as with the boom 80 extending to a substantially parallel position with the king post 78 (which is shown in FIG. 1C at about a 45 degree angle), to a second position, such as with the boom 80 extending substantially perpendicular to the king post 78. The boom 80 can pivot to any position between the first position and the second position, such as by using a first luffing wire 82 and a second luffing wire 84. The boom 80 is depicted in the second position in FIGS. 1A-1B.

The first luffing wire 82 and the second luffing wire 84 can each connect to the boom 80 at one end and to the king post 78 at the opposite end. The first luffing wire 82 can engage a first turn down sheave 86 mounted to the king post 78. The second luffing wire 84 can engage a second turn down sheave 88 mounted to the king post 78. The first and second turn down sheaves 86 and 88 can be mounted to the king post 78 with a sheave mount 93*a*.

The first luffing wire 82 can extend from the first turn down sheave 86 to the first tensioner 90, which can function to apply and release tension to the first luffing wire 82. The amount of tension applied to the first luffing wire 82 can be an amount sufficient to hold the first telescoping soft yoke mooring arm 68 or greater. The second luffing wire 84 can extend from the second turn down sheave 88 to the second tensioner 91, which can function to apply and release tension to the second luffing wire 84. The amount of tension applied to the second luffing wire 84 can be an amount sufficient to hold the telescoping soft yoke mooring arm 68 or greater.

For example, in operation the first and second tensioners 90 and 91 can be used to apply tension to the first and second luffing wires 82 and 84, allowing the boom 80 to be raised towards the first position with an upward movement away from any deck of a transport vessel. When the first and second tensioners 90 and 91 release tension from the first and second luffing wires 82 and 84, the boom 80 can be lowered towards the second position with a downward movement towards a surface of the sea and towards a deck of a transport vessel.

A jib 92 can be nested within the boom 80, allowing the jib 92 to have an extended position and a retracted position, and enabling the jib 92 to be telescopically contained within the boom 80. The jib 92 can be a tubular. The jib 92 can have a diameter ranging from about 12 feet to about 14 feet. The tubulars of the jib 92 can be made of hollow tubular steel.

The jib 92 can be controlled by at least one centralizing cylinder, such as a first centralizing cylinder 94 and a second centralizing cylinder 95.

The first and second centralizing cylinders 94 and 95 can control a position of the jib 92 within the boom 80. For example, the first and second centralizing cylinders 94 and 95 can be mounted in parallel on the opposite sides of the boom 80 to extend and retract the jib 92 within the boom 80.

The soft yoke 66 can connect between a floating gas processing station or the like and a transport vessel or the like. As such, the soft yoke 66 can be used to accommodate for environmental factors that can shift a position of the transport vessel, the floating natural gas processing station, the soft yoke 66, the like, or combinations thereof, to allow for continuous loading of liquefied natural gas, and to allow for safe transfer of people and equipment over a gangway formed using the soft yoke 66.

The soft yoke 66 can provide for higher levels of safety by maintaining safe distances using computer controlled devices between the transport vessel and the floating natural gas processing station and the like, and by providing for quick connects and emergency disconnects in case of fire, high winds, or rogue waves. The environmental factors can include wave motions, current motions, wind, transport vessel dynamics or the like, floating natural gas processing station dynamics or the like, changes in draft, and other such external and internal variables.

The first and second centralizing cylinders 94 and 95 can each be hydraulic or pneumatic cylinders, or combinations thereof, and can be connected to one or more accumulators 104*a*, 104*b*, 104*c*, and 104*d*. Any number of accumulators can be used.

The first and second centralizing cylinders 94 and 95 can extend and retract the jib 92 to maintain the transport vessel or the like at a nominal standoff position within preset limits from the floating natural gas processing station or the like.

The soft yoke 66 can prevent disconnection of any conduits communicating between the floating natural gas processing station and the transport vessel or the like, by maintaining the correct spacing there between.

Preset distances or limits from the floating natural gas processing station or the like can be any distance required for the particular application. The preset limits can be any allowable range of variation from the predefined distance required for the particular application. For example, in an application with a nominal distance of one hundred feet, and a preset limit of plus or minus ten feet, the first and second centralizing cylinders 94 and 95 can operate to extend and retract the jib 92 to maintain the nominal standoff position from about ninety feet to about one hundred ten feet. The nominal standoff position can be a length of the boom 80 plus a length of the jib 92 extending from the boom 80.

The soft yoke 66 can include conduits for flowing fluid between floating natural gas processing stations and transport vessels or the like. For example, the soft yoke 66 can include a yoke offload flexible conduit 98 and a yoke vapor return flexible conduit 99. The yoke offload flexible conduit 98 can be used to flow fluid, such as liquefied natural gas, from the floating natural gas processing stations to waiting transport vessels or the like. The fluid can be a liquefied natural gas or another liquid.

The yoke offload flexible conduit 98 can flow the fluid from the floating natural gas processing station into storage tanks on the transport vessel. The transport vessel can receive, store, transport, and offload the fluid.

The yoke vapor return conduit 99 can flow hydrocarbon vapor formed during offloading of the fluid back from the transport vessel to the floating natural gas processing station. For example, the yoke vapor return flexible conduit 99 can be in fluid communication with a station heat exchanger (shown in FIG. 5). The station heat exchanger can be a cold box, for receiving the formed vapor and cooling the vapor for reprocessing using a station mounted liquefaction train (also shown in FIG. 5). The hydrocarbon vapor can serve as a fuel supply for the floating natural gas processing station or the like.

The yoke offload flexible conduit 98 and the yoke vapor return conduit 99 can each be made from about eight inch to about ten inch diameter rigid pipe, or from a similar diameter flexible composite cryogenic hose, or combinations thereof. The yoke offload flexible conduit 98 and the yoke vapor return conduit 99 can be any size or material as required for the particular application, given particular flow rates, pressures, and storm conditions. For example, the yoke offload flexible conduit 98 and the yoke vapor return conduit 99 can be 3 inch or larger diameter reinforced hose, a draped hose, or a festooned hose.

The yoke offload flexible conduit 98 can have a jib flexible portion 109*a*, and the yoke vapor return flexible conduit 99 can have a jib flexible portion 109*b*. The jib flexible portions 109*a* and 109*b* can allow the yoke offload flexible conduit 98 and the yoke vapor return conduit 99 to move easily along with the boom 80 as the jib 92 expands and retracts within the boom 80. Since the boom 80 can be raised and lowered using the first and second tensioners 90 and 91, the jib flexible portions 109*a* and 109*b* can enable the yoke offload flexible conduit 98 and the yoke vapor return conduit 99 to have enough range of motion and flexibility to move with the boom 80 without fracturing or being over tensioned.

The yoke offload flexible conduit 98 can have a first rigid portion 110*a*, and the yoke vapor return flexible conduit 99 can have a second rigid portion 110*b*. The rigid portions 110*a* and 110*b* can provide a rigid connection between the yoke offload flexible conduit 98, the yoke vapor return conduit 99, and the boom 80, allowing the boom 80 to securely move the yoke offload flexible conduit 98 and the yoke vapor return conduit 99 as the boom 80 moves.

The yoke offload flexible conduit 98 and the yoke vapor return flexible conduit 99 can be secured to the boom 80, such as by gussets 105*a* and 105*b*, and support structures 114*a*, 114*b*, and 114*c*. Each support structure 114*a*, 114*b*, and 114 and gusset 105*a* and 105*b* can be pivotable and/or rotatable.

The soft yoke 66 can include one or more low pressure fluid accumulators 113*a*, 113*b*, 113*c*, and 113*d* for the first and second centralizing cylinders 94 and 95. The one or more low pressure accumulators 113*a*, 113*b*, 113*c*, and 113*d* can have a pressure from about 30 psi to about 300 psi each.

The soft yoke 66 can include a connection interface 103 for connecting the soft yoke 66 to the transport vessel or the like. For example, the connection interface 103 can be a primary quick connect/disconnect connector with a secondary emergency disconnect connector and a tertiary disconnect connector that engages a mooring socket on a transport vessel.

The soft yoke 66 can include a stop 404 configured to selectively engage a hydraulic actuator switch 404. For example, the stop 404 can be located on the boom 80, and the hydraulic actuator switch 403 can be located on the jib 92.

FIG. 1C depicts the boom 80 connected to the king post 78 with the first luffing wire 82. The first luffing wire 82 can hold the boom 80 in a first position 107. The second position 108 also is depicted. The boom 80 can be lowered to the second position 108. Also shown are the jib 92 and the jib flexible portion 109*a*.

Figure 2A:
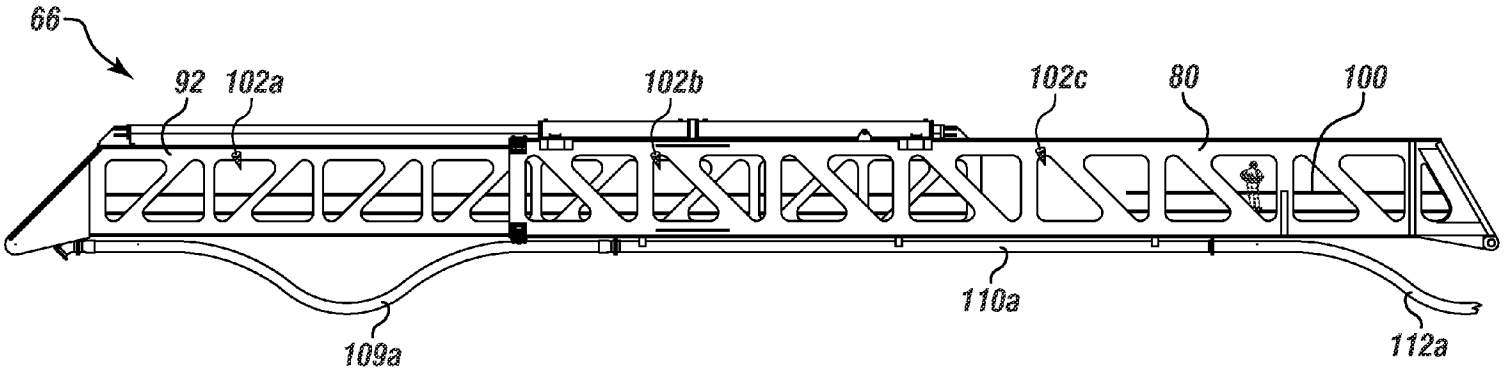
FIG. 2A depicts a side view of a portion of the soft yoke in an extended position.

FIG. 2A depicts the soft yoke 66 with the jib 92 and the boom 80 nested together. A secure enclosed gangway 100 can be formed that allows wind and water to pass through the secure enclosed gangway 100 without deforming, and allows people to pass between the transport vessel and the floating station or the like.

The secure enclosed gangway 100 can have openings 102*a*, 102*b*, and 102*c*, which can provide ventilation and allow spray and wind to pass through the secure enclosed gangway 100 without pulling a person into the sea.

The secure enclosed gangway 100 can function to allow for personnel to move between transport vessel and floating natural gas processing stations when the soft yoke 66 is connected there between. The secure enclosed gangway 100 can be made of aluminum, steel, or another material. The secure enclosed gangway 100 can have an anti-slip tread, handrails, lighting, and other safety features.

The jib 92 is depicted in a partially extended position relative to the boom 80 with the jib flexible portion 109*a* slightly tensioned as it connects to the rigid portion 110*a*. The rigid portion 110*a* is shown connected to the boom flexible portion 112*a*.

The boom flexible portion 112*a* can allow the conduits of the soft yoke 66 to move extend and retract along with the jib 92. For example, when the jib 92 is extended and retracted using the centralizing cylinders, the boom flexible portion 112*a* can provide the conduits with enough range of motion and flexibility to extend and retract with the jib 92 without fracturing or being over tensioned.

Figure 2B:
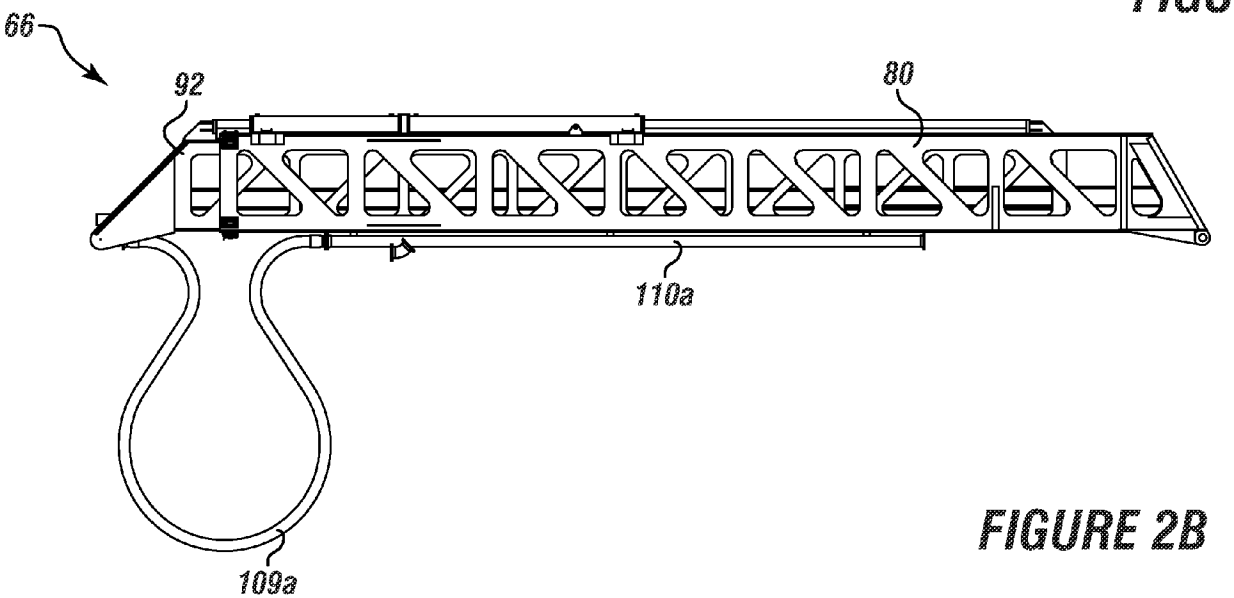
FIG. 2B depicts a side view of a portion of the soft yoke in a retracted position.

FIG. 2B depicts the same side view of a portion of the soft yoke 66 as FIG. 2A with the jib 92 depicted in a retracted position relative to the boom 80. The jib flexible portion 109*a* is depicted connected to the rigid portion 110*a*, with little or no tension, having an extra "scope" or lengths in a loop.

The jib flexible portion 109*a* is configured to have a length sufficient to have enough range of motion and flexibility to extend and retract along with the jib 92. The boom flexible portion can be configured the same as the jib flexible portion 109*a*, and can function in the same manner.

Figure 2C:
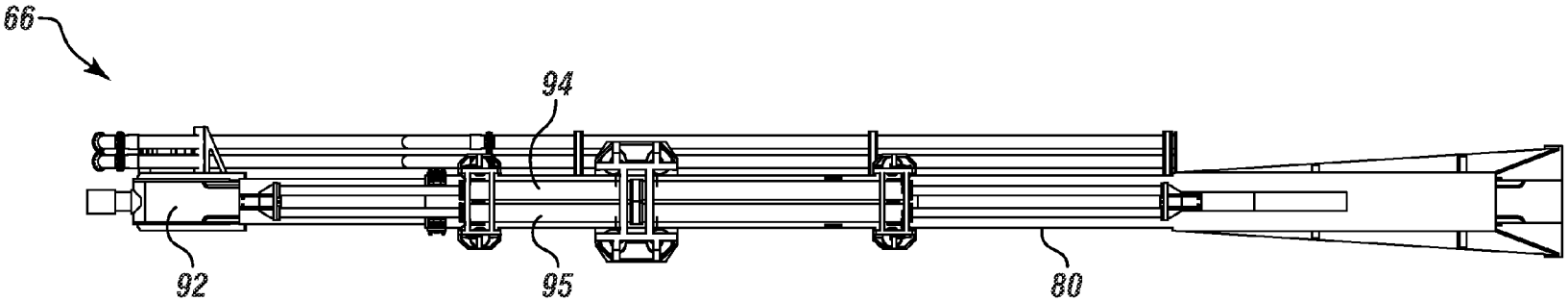
FIG. 2C depicts a top view of a portion of the soft yoke in the extended position.

FIG. 2C depicts a top view of a portion of the soft yoke 66 having the first and second centralizing cylinders 94 and 95 configured to actuate for extending and retracting the jib 92 relative to the boom 80.

Figure 3A:
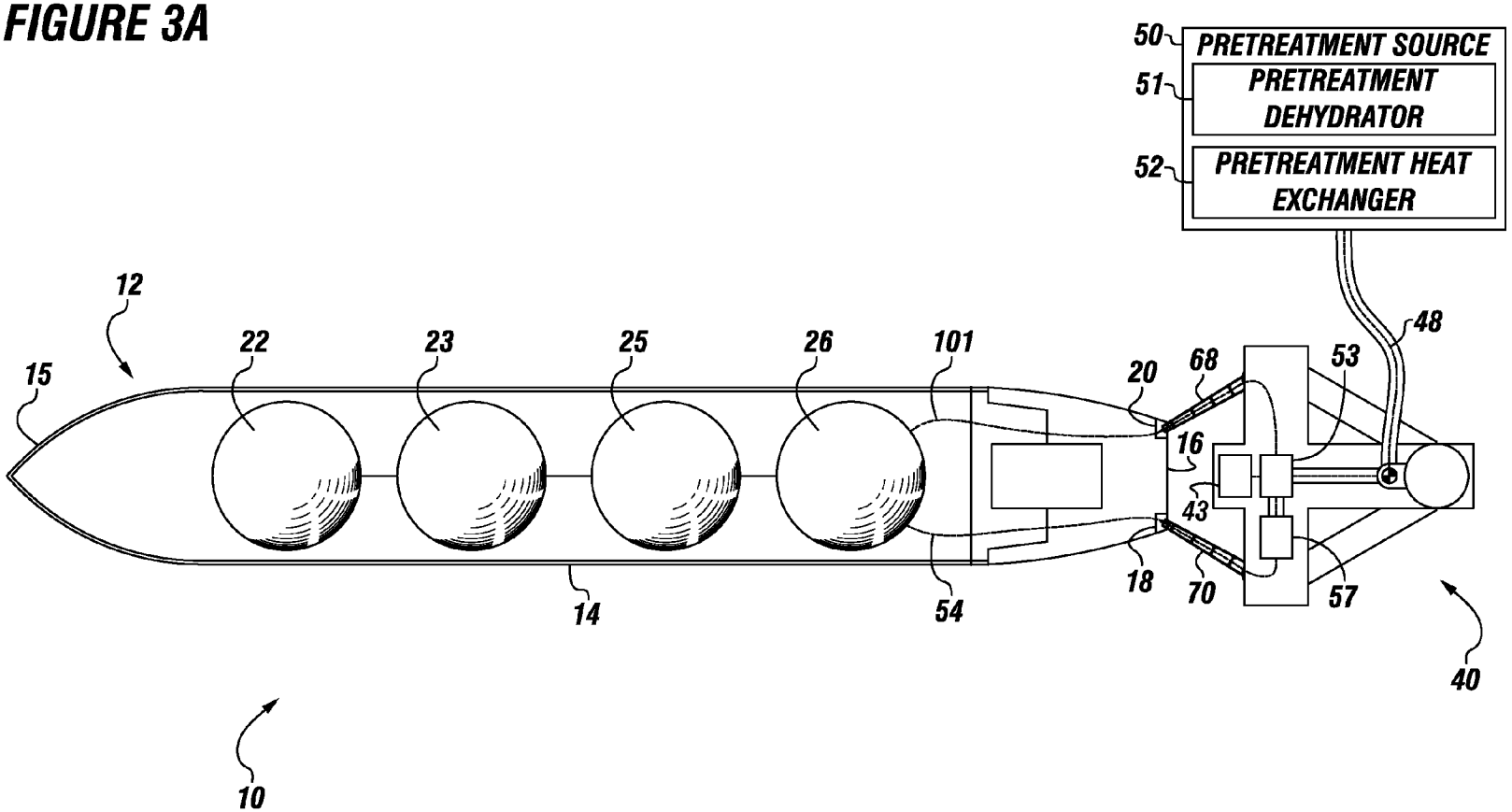
FIG. 3A depicts two soft yoke mooring arms connecting between a floating station and a transport vessel.

FIG. 3A depicts a top view of a system 10 with the first telescoping soft yoke mooring arm 68 and a second telescoping soft yoke mooring arm of 70 connecting the floating natural gas processing station 40 to a transport vessel 12. The transport vessel 12 can have a vessel hull 14 between a bow 15 and stern 16. The floating natural gas processing station 40 is depicted as a semisubmersible structure.

In one or more embodiments, the first and second telescoping soft yoke mooring arms 68 and 70 can connect directly to the stern 16 of the transport vessel 12, with the first and second telescoping soft yoke mooring arms 68 and 70 both angled inwards towards the stern 16. First and second mooring sockets 18 and 20 can connect the first and second telescoping soft yoke mooring arms 68 and 70 to stern 16.

A station heat exchanger 53 can be connected to a pretreatment source 50 for receiving dry gas 48 from the pretreatment source 50.

The pretreatment source 50 can have a pretreatment dehydrator 51 and a pretreatment heat exchanger 52. Accordingly, the pretreatment source 50 can be configured to cool and dry natural gas from a wellbore or other source.

The liquefied natural gas 54 can flow from station offload flexible conduits, which are also termed "offload flexible conduits" herein, through the yoke offload conduits to liquefied natural gas storage tanks 22, 23, 25, and 26 on the transport vessel 12.

A hydrocarbon vapor 101 can flow from the transport vessel 12, through yoke vapor return flexible conduits, through station vapor return flexible conduits, and to the station heat exchanger 53.

A station controller 43 can be located on the floating natural gas processing station 40 to control one or more components thereof. The floating natural gas processing station 40 can include one or more liquefaction trains 57 in communication with the station heat exchanger 53.

Figure 3B:
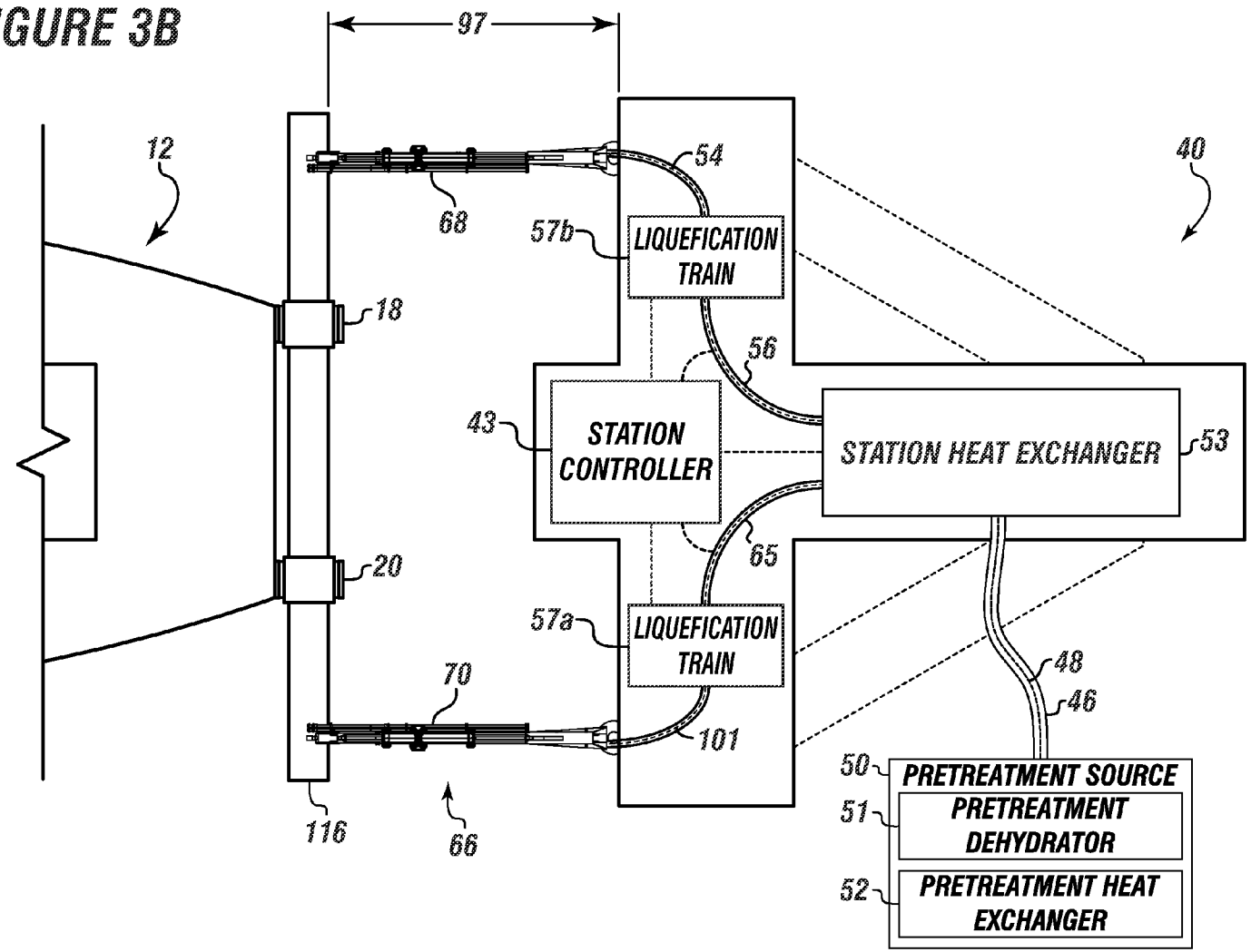
FIG. 3B depicts two soft yoke mooring arms connected to a docking bar removably connected to a transport vessel.

FIG. 3B depicts an embodiment of a floating natural gas processing station 40 connected to a transport vessel 12 using the soft yoke 66 with the first telescoping soft yoke mooring arm 68 and the second telescoping soft yoke mooring arm 70 connected to a docking bar 116. The docking bar 116 can connect to the transport vessel 12 via first and second morning sockets 18 and 20.

The station controller 43 can control flow of liquefied natural gas 54, hydrocarbon vapor 101, and can control the station heat exchanger 53.

The transport vessel 12 can be positioned at a nominal standoff position 97 relative to the floating natural gas processing station 40. In one or more embodiments, the first and second telescoping soft yoke mooring arms 68 and 70 can be connected directly to the transport vessel 12 or to the docking bar 116, allowing versatility of connection for vessels with small narrow sterns, and for vessels with larger, wider sterns.

The pretreatment source 50 can communicate with the station heat exchanger 53 via inlet conduit 46, allowing dry gas 48 to flow to the station heat exchanger 53 after passing through the pretreatment heat exchanger 52 and the pretreatment dehydrator 51.

The liquefied natural gas 54 can flow from the floating natural gas processing station 40, through an offload flexible conduit 56 and through corresponding yoke offload flexible conduits on the soft yoke 66 to the transport vessel 12.

The hydrocarbon vapor 101 can return from the transport vessel 12 through yoke vapor return flexible conduits on the soft yoke and through a corresponding vapor return flexible conduit 65 on the floating natural gas processing station 40.

The liquefaction trains 57*a* and 57*b* can functions to cool the station heat exchanger 53. The liquefied natural gas 54 and the hydrocarbon vapor 101 can flow through the liquefaction trains 57*a* and 57*b* between the transport vessel 12 and the station heat exchanger 53.

Figure 4A:
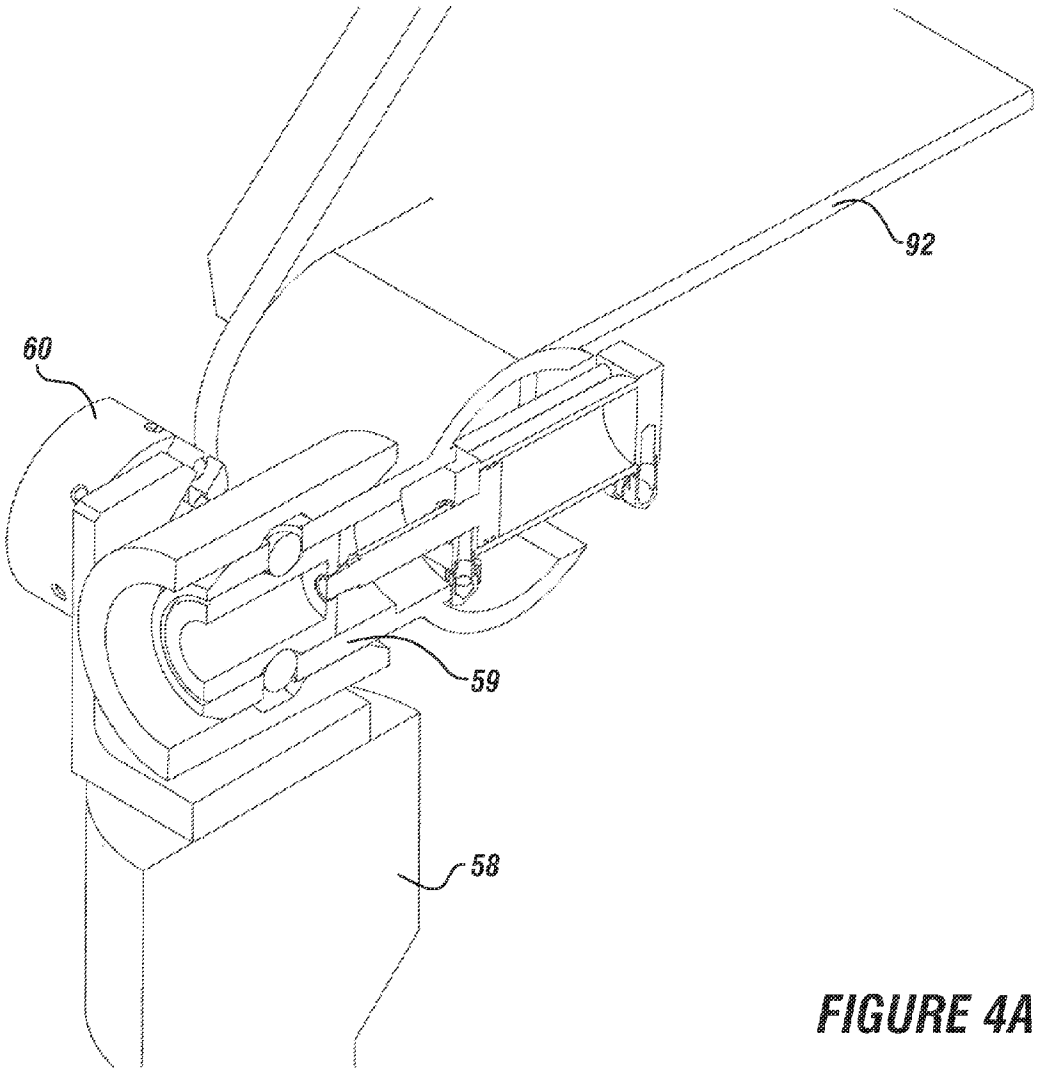
FIG. 4A depicts a cut away view of a secondary emergency disconnect connector along with a primary quick release connector and a tertiary emergency disconnect release connector.

FIG. 4A shows the three connectors usable with the system, the primary quick connect/disconnect connector 58, the secondary emergency disconnect connector 59 and the tertiary emergency disconnect connector 60 that connect to the jib 92.

The primary quick connect/disconnect connector 58 can engage a mooring socket on the transport vessel. Hydraulic cylinders can force the quick connect/disconnect connector 58 into the mooring socket.

Figure 4B:
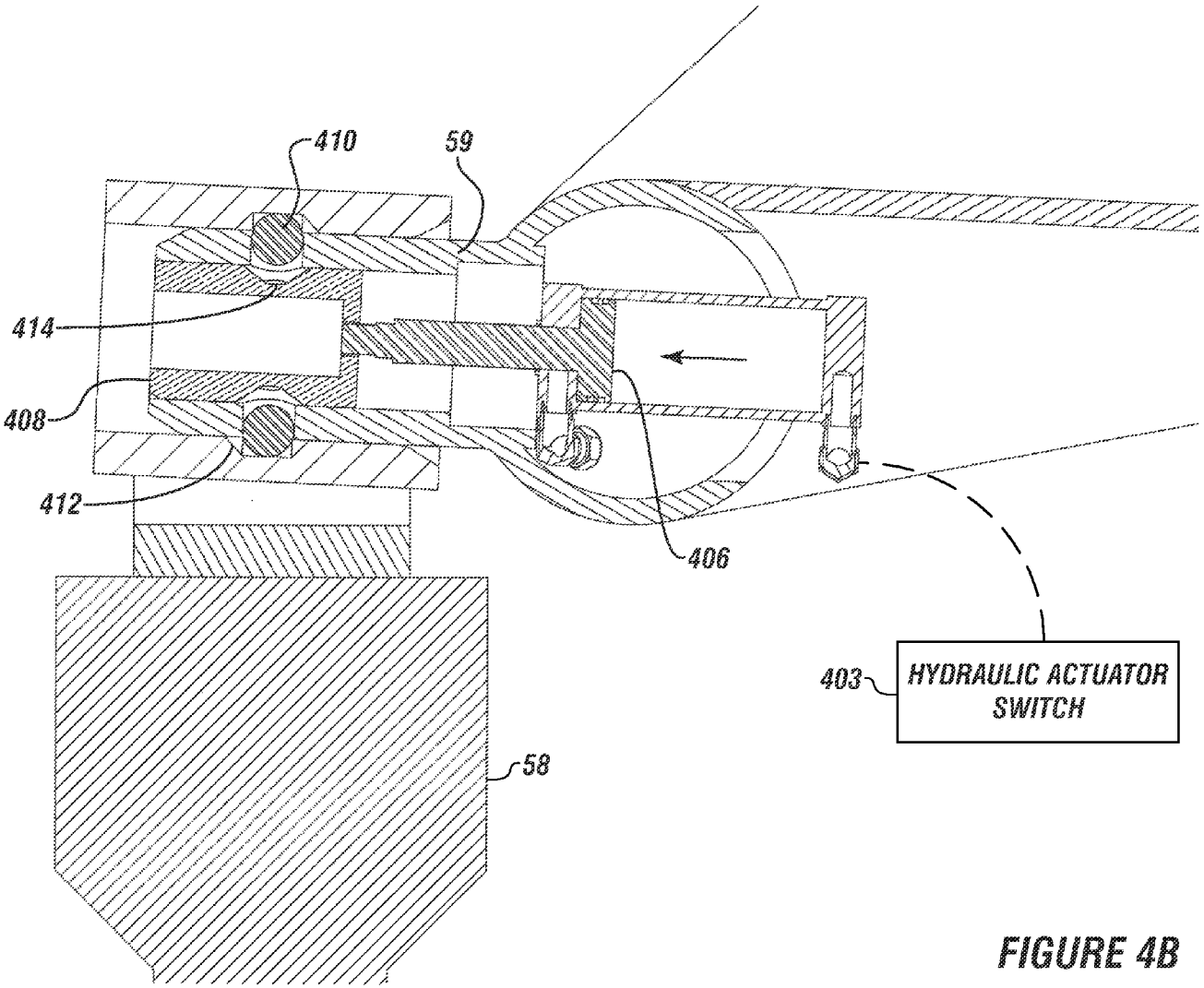
FIG. 4B shows a detailed view of the secondary emergency disconnect connector.

FIG. 4B depicts in detail the secondary emergency disconnect connector 59 engaging between the tip of the jib and a first lock release 408 to allow the jib and boom assembly to disconnect and slide away from the primary quick connect/disconnect connector 58.

The secondary emergency disconnect connector 59 can be operatively engaged with an emergency actuator 406, which can be operatively engaged with a hydraulic actuator switch 403. The first lock release 408 can have a pin recess 414 for operatively engaging the emergency actuator 406. Quick release bearings 410 can be disposed between the first lock release 408 and a locking recess sleeve 412.

In operation, the secondary emergency disconnect connector 59 can connect the soft yoke to the transport vessel. A stop can be configured to engage the hydraulic actuator switch 403 when the jib has reached a maximum extension length relative to the boom. The hydraulic actuator switch 403 can be configured to flow hydraulic fluid to the hydraulic actuator 406 upon engagement with the stop. The hydraulic actuator 406 can receive the flowing fluid from the hydraulic actuator switch 403. The hydraulic actuator 406 can push the first lock release 408 upon receipt of the fluid from the hydraulic actuator switch 403.

The first lock release 408 can then disengage the quick release bearings 410 and release the telescoping soft yoke mooring arms from the transport vessel. The quick release bearings 410 move from being engaged within a locking recess sleeve 412 to within a pin recess 414, thereby releasing the soft yoke from the transport vessel.

Figure 5:
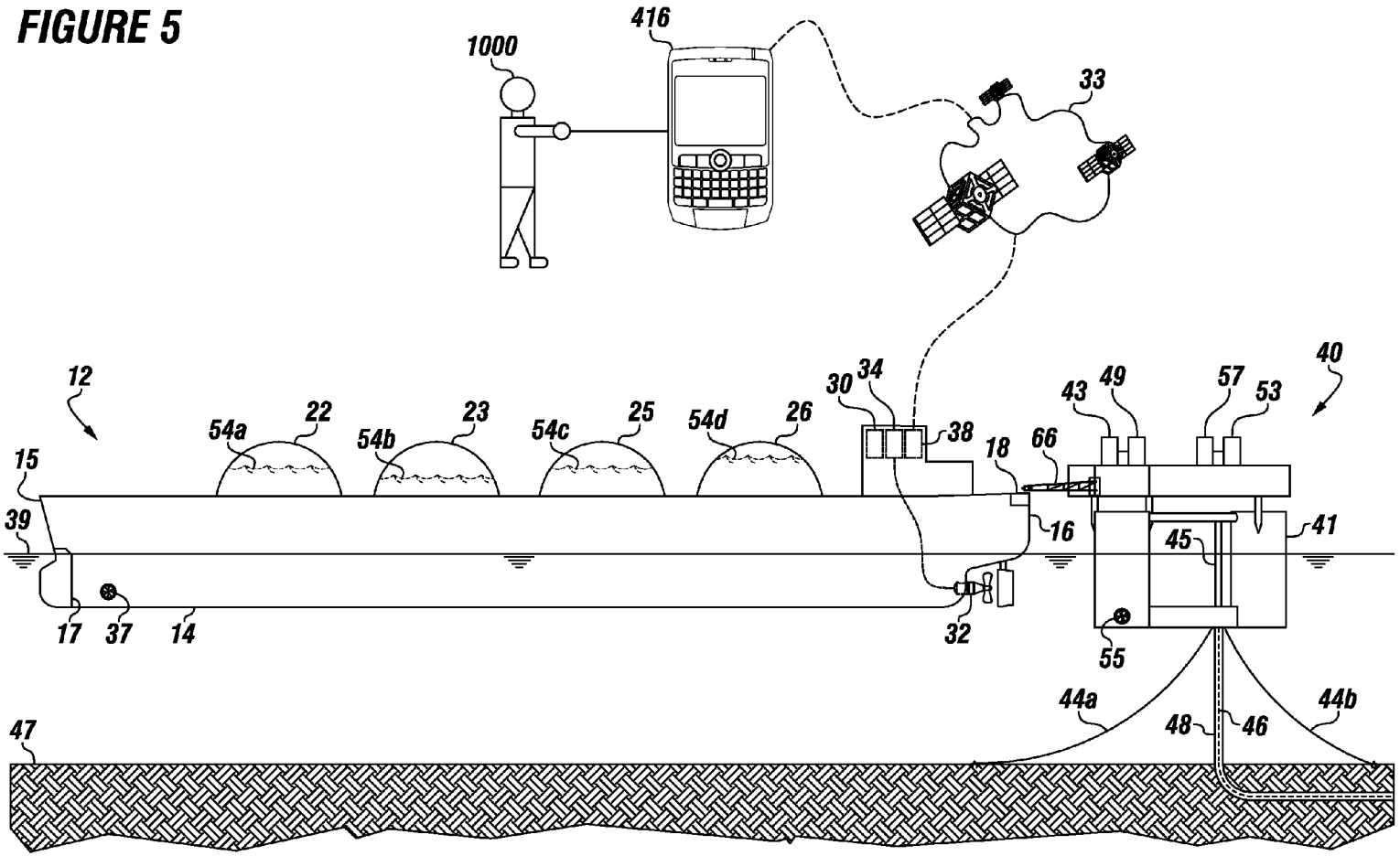
FIG. 5 depicts a soft yoke connecting between a transport vessel and a floating station along with a user in communication with a network.

FIG. 5 depicts a floating natural gas processing station 40 with a soft yoke 66 and a spread moored turret 45. The spread moored turret 45 can be moored to the sea bed 47 with mooring lines 44*a* and 44*b*.

A dry gas inlet conduit 46 can extend into the spread moored turret 45 for communicating dry gas 48 from a pretreatment source for processing on the floating natural gas processing station 40 with a natural gas liquefaction train 57.

The spread moored turret 45 allows the floating natural gas processing station 40 to weather vane according to weather conditions, wind direction, and waves. For example, the spread moored turret 45 allows the floating natural gas processing station 40 to pivot and/or rotate about the spread moored turret 45, while the spread moored turret 45 is fixed by the mooring lines 44*a* and 44*b*.

The floating natural gas processing station 40 can be a ballasted floating vessel with a station hull 41 with a station variable draft.

In embodiments, the floating natural gas processing station 40 can use heading controls 49 connected to thrusters 55, allowing the floating natural gas production station 40 to dynamically maintain position with the transport vessel 12 using GPS positioning with other dynamic positioning equipment to maintain space between the floating natural gas processing station 40 and the transport vessel 12.

A vessel controller 43 can be connected to the heading controls 49 and the station thrusters 55.

The stern 16 of the transport vessel 12 can connect directly to the boom of the soft yoke 66. For example, a first mooring socket 18 can connect to the soft yoke 66. Pivot can be employed with the soft yoke 66 to rotate the mooring arms of the soft yoke 66, allowing the liquefied natural gas 54*a*, 54*b*, 54*c*, and 54*d* to flow into the storage tanks 22, 23, 25, and 26 from the natural gas liquefaction train 57 and/or the station heat exchanger 53.

The transport vessel 12 is shown having a hull 14 with a variable draft 17, allowing the transport vessel 12 to change draft and balance with respect to sea level 39 to be capable of receiving and offloading the processed liquefied natural gas 54*a*-54*d*.

The transport vessel 12 can have a bow 15 opposite the stern 16, with the storage tanks 22, 23, 24, 25, and 26 located on the hull 14. The storage tanks 22, 23, 24, 25 and 26 can be independent of each other.

The transport vessel 12 can include a vessel controller 30 with a processor and data storage for monitoring data associated with the receipt of the processed liquefied natural gas 54*a*-54*d*, the storage of the processed liquefied natural gas 54*a*-54*d*, and the offloading the processed liquefied natural gas 54*a*-54*d* from the transport vessel 12.

The transport vessel 12 can include a propulsion system 32 for moving the transport vessel 12 and a navigation system 34 for controlling the propulsion system 32.

The transport vessel 12 can have a station keeping device 38 that operates dynamic positioning thrusters 37. The station keeping device 38 and the navigation system 34 can communicate with a network 33, shown here as a satellite network, for dynamic positioning of the floating vessel 12. Client devices 416 with computer instructions can communicate with the network 33, allowing a remote user 1000 to monitor the processing, storage, and offloading.

Figure 6A:
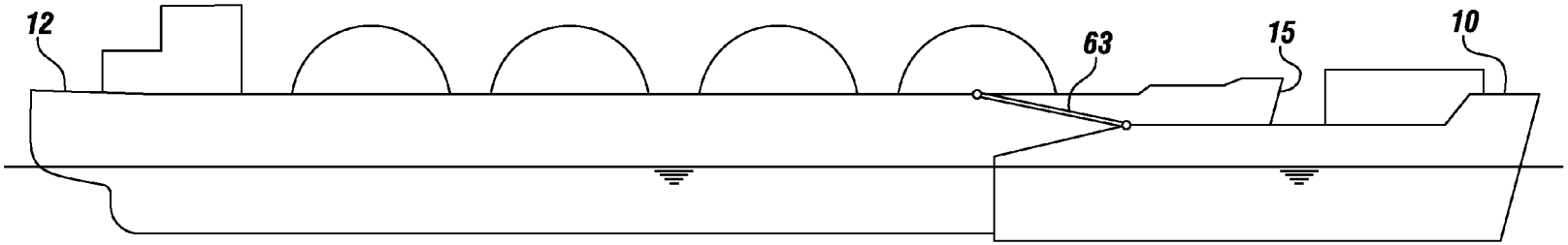
FIG. 6A depicts a side view of a transport vessel connected to a floating station using a docking notch and at least one mooring arm.
Figure 6B:
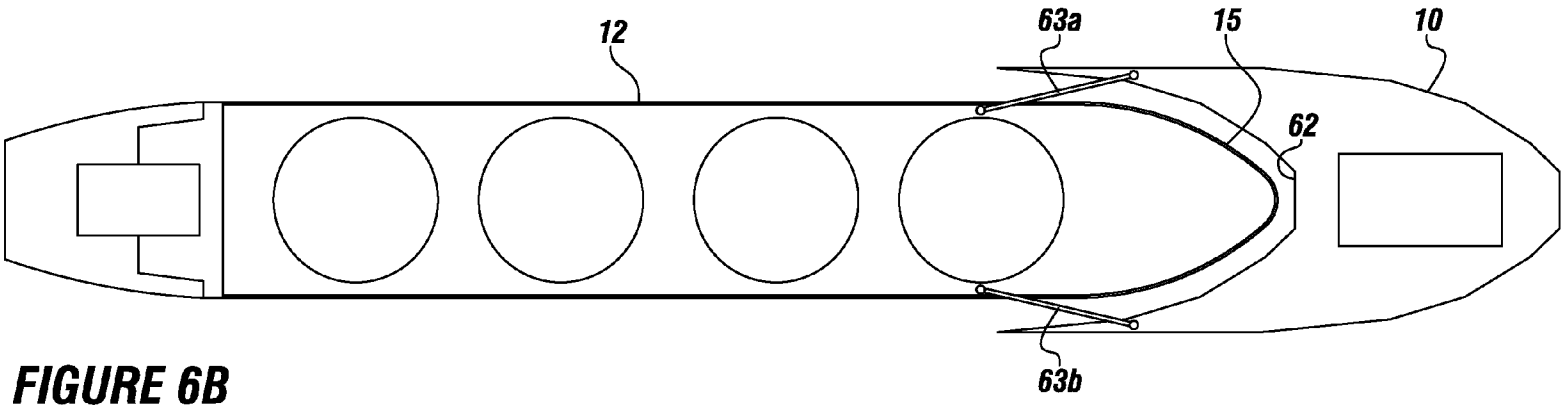
FIG. 6B depicts a top view of the embodiment of FIG. 6A.

FIGS. 6A and 6B depict an embodiment for connecting a transport vessel 12 and a floating natural gas processing station 10. The floating natural gas processing station 10 is depicted as a floating vessel without propulsion, such as a barge. The floating natural gas processing station 10 can have a docking notch 62 for accepting the bow 15 of the transport vessel 12. Mooring arms 63, 63*a*, and 63*b* are shown connected to the station hull of the floating natural gas processing station 10 for holding the transport vessel 12 in the docking notch 62.

The floating natural gas processing station 10 can have a station variable draft and can be ballasted like the transport vessel 12.

Figure 7:
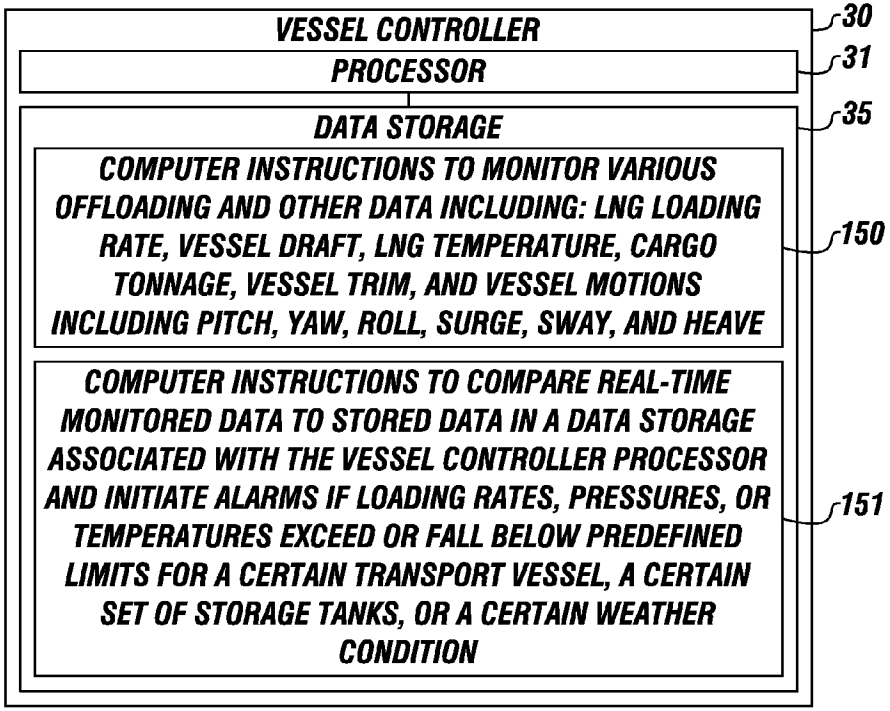
FIG. 7 depicts an embodiment of a vessel controller.

FIG. 7 depicts an embodiment of a vessel controller 30 with a processor 31 and a data storage 35.

The data storage 35 can have computer instructions 150 to monitor various offloading and other data including: LNG loading rate, vessel draft, LNG temperature, cargo tonnage, vessel trim, and vessel motions including pitch, yaw, roll, surge, sway, and heave.

The data storage 35 can have computer instructions 151 to compare real-time monitored data to stored data in a data storage associated with the vessel controller processor and initiate alarms if loading rates, pressures, or temperatures exceed or fall below predefined limits for a certain transport vessel, a certain set of storage tanks, or a certain weather condition.

Figure 8:
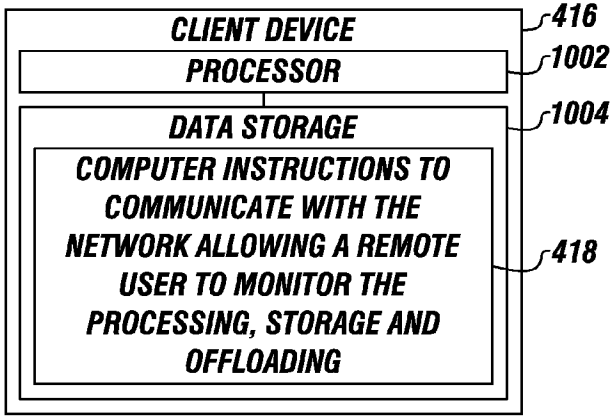
FIG. 8 depicts an embodiment of a client device.

FIG. 8 depicts an embodiment of a client device 416 with a processor 1002 and a data storage 1004. The data storage 1004 can have computer instructions 418 to communicate with the network allowing a remote user to monitor the processing, storage and offloading.

Figure 9:
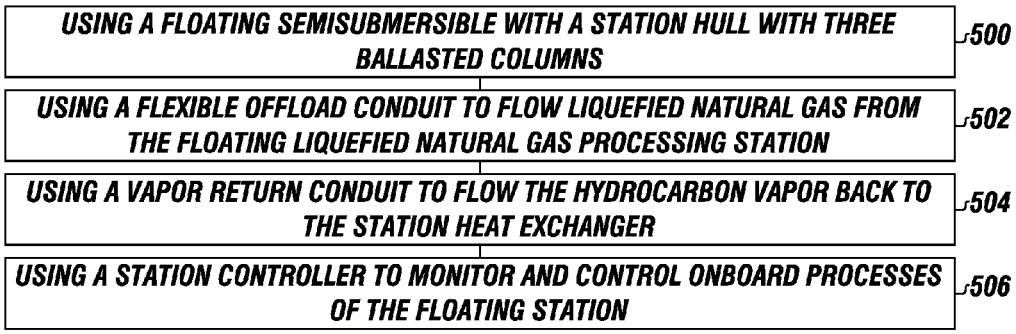
FIG. 9 depicts a flow chart of an embodiment of the method.

FIG. 9 depicts an embodiment of the method. The method can be a floating relocatable method for offloading a fluid from a fixed or floating vessel to a moveable floating transport vessel for storage and transport to another location.

Step 500 can include using a floating semisubmersible with a station hull with three ballasted columns.

The station hull can be 3 column hull, 4 column, 5 column, 8 column, 12 column, or other sized hull.

Step 502 can include using a flexible offload conduit to flow liquefied natural gas from the floating liquefied natural gas processing station.

Step 504 can include using a vapor return conduit to flow the hydrocarbon vapor back to the station heat exchanger.

Step 506 can include using a station controller to monitor and control onboard processes of the floating station.

The station controller can monitor and control the dry gas inlet conduit, the station heat exchanger, and the flexible outlet conduit.

Figure 10B:
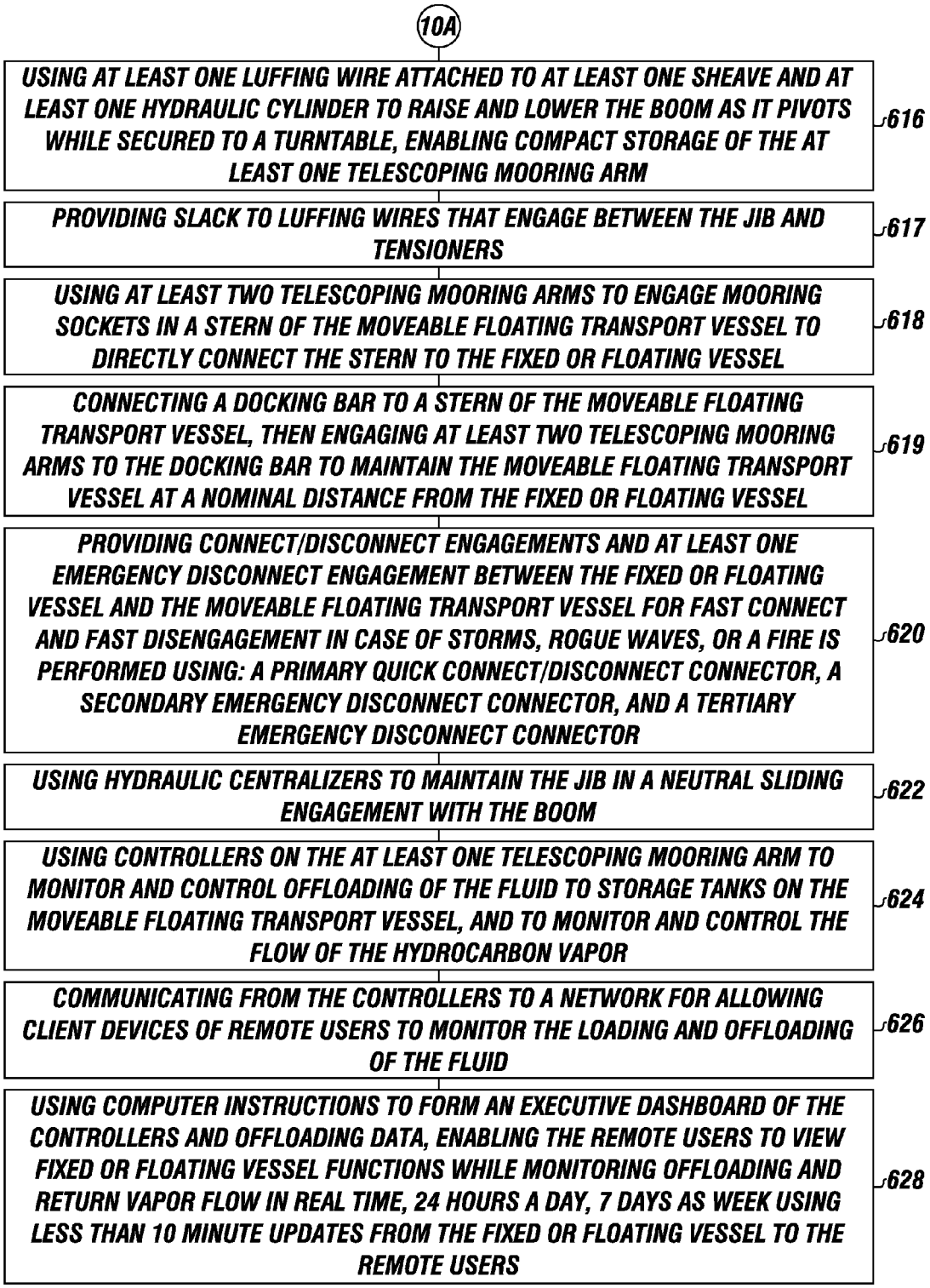

FIGS. 10A-10B depict a flow diagram of an embodiment of the method for offloading a fluid that produces a hydrocarbon vapor from a fixed or floating vessel to a moveable floating transport vessel for storage and transport to another location.

Step 600 can include flowing the fluid that produces a hydrocarbon vapor from the fixed or floating vessel to the moveable floating transport vessel using at least one telescoping mooring arm having connected thereto at least one offload flexible conduit for flowing the fluid.

Step 602 can include adjusting the at least one offload flexible conduit to accommodate fixed or floating vessel motion, moveable floating transport vessel motion, wave motion, current motion, and other weather motion without disengaging.

Step 604 can include simultaneously and dynamically using a sliding engagement between a jib nested in a boom to connect the fixed or floating vessel to the moveable floating transport vessel during offloading of the fluid.

Step 605 can include forming a telescoping and dynamically moving enclosed gangway to safely transport personnel and equipment between the moveable floating transport vessel and the fixed or floating vessel.

Step 606 can include monitoring while offloading and returning the hydrocarbon vapor from the moveable floating transport vessel during offloading of the fluid.

The method can therefore be used to prevent excursions to atmosphere.

Step 608 can include accommodating moveable floating transport vessels with a variety of stern configurations.

Step 610 can include providing connect/disconnect engagements and at least one emergency disconnect engagement between the fixed or floating vessel and the moveable floating transport vessel for fast connect and fast disengagement in case of storms, rogue waves, or a fire.

Step 611 can include recycling the hydrocarbon vapor to the fixed or floating vessel using a vapor return flexible conduit, and maintaining a cryogenic temperature using a flow rate substantially the same as a rate at which the fixed or floating vessel uses fuel.

Step 612 can include transporting the fluid in the offload flexible conduit at a cryogenic temperature of colder than −262 degrees Fahrenheit using a flow rate substantially the same as the rate at which the fixed or floating vessel uses fuel.

Step 614 can include using an accumulator to manage pressure in a cylinder used to control the sliding engagement between the jib and the boom for maintaining a distance between the moveable floating transport vessel and the fixed or floating vessel at a preset distance.

Step 616 can include using at least one luffing wire attached to at least one sheave and at least one hydraulic cylinder to raise and lower the boom as it pivots while secured to a turntable, enabling compact storage of the at least one telescoping mooring arm.

As such, the method can enable for compact storage of the telescoping mooring arms.

Step 617 can include providing slack to luffing wires that engage between the jib and tensioners.

Step 618 can include using at least two telescoping mooring arms to engage mooring sockets in a stern of the moveable floating transport vessel to directly connect the stern to the fixed or floating vessel.

Step 619 can include connecting a docking bar to a stern of the moveable floating transport vessel, then engaging at least two telescoping mooring arms to the docking bar to maintain the moveable floating transport vessel at a nominal distance from the fixed or floating vessel.

Step 620 can include providing connect/disconnect engagements and at least one emergency disconnect engagement between the fixed or floating vessel and the moveable floating transport vessel for fast connect and fast disengagement in case of storms, rogue waves, or a fire is performed using: a primary quick connect/disconnect connector, a secondary emergency disconnect connector, and a tertiary emergency disconnect connector.

Step 622 can include using hydraulic centralizers to maintain the jib in a neutral sliding engagement with the boom.

Step 624 can include using controllers on the at least one telescoping mooring arm to monitor and control offloading of the fluid to storage tanks on the moveable floating transport vessel, and to monitor and control the flow of the hydrocarbon vapor.

Step 626 can include communicating from the controllers to a network for allowing client devices of remote users to monitor the loading and offloading of the fluid.

Step 628 can include using computer instructions to form an executive dashboard of the controllers and offloading data, enabling the remote users to view fixed or floating vessel functions while monitoring offloading and return vapor flow in real time, 24 hours a day, 7 days as week using less than 10 minute updates from the fixed or floating vessel to the remote users.

While these embodiments have been described with emphasis on the embodiments, it should be understood that within the scope of the appended claims, the embodiments might be practiced other than as specifically described herein.

What is claimed is:

1. A floating relocatable method for offloading a fluid from a fixed or floating vessel to a moveable floating transport vessel for storage and transport to another location, the method comprising:

a. flowing the fluid that produces a hydrocarbon vapor from the fixed or floating vessel to the moveable floating transport vessel using at least one telescoping mooring arm having connected thereto at least one offload flexible conduit for flowing the fluid, wherein the at least one offload flexible conduit is adjustable to accommodate fixed or floating vessel motion, moveable floating transport vessel motion, wave motion, current motion, and other weather motion without disengaging, simultaneously while dynamically using a sliding engagement between a jib nested in a boom to connect the fixed or floating vessel to the moveable floating transport vessel during offloading of the fluid;

b. forming a telescoping and dynamically moving enclosed gangway to safely transport personnel and equipment between the moveable floating transport vessel and the fixed or floating vessel;

c. monitoring while offloading and returning the hydrocarbon vapor from the moveable floating transport vessel during offloading of the fluid;

d. accommodating moveable floating transport vessels with a variety of stern configurations; and e. providing connect/disconnect engagements and at least one emergency disconnect engagement between the fixed or floating vessel and the moveable floating transport vessel for fast connect and fast disengagement in case of storms, rogue waves, or a fire.

2. The method of claim 1, further comprising recycling the hydrocarbon vapor to the fixed or floating vessel using a vapor return flexible conduit, and maintaining a cryogenic temperature using a flow rate substantially the same as a rate at which the fixed or floating vessel uses fuel.

3. The method of claim 1, further comprising using an accumulator to manage pressure in a cylinder used to control the sliding engagement between the jib and the boom for maintaining a distance between the moveable floating transport vessel and the fixed or floating vessel at a preset distance.

4. The method of claim 1, further comprising using at least one luffing wire attached to at least one sheave and at least one hydraulic cylinder to raise and lower the boom as it pivots while secured to a turntable, enabling compact storage of the at least one telescoping mooring arm.

5. The method of claim 1, wherein the fluid is a liquefied natural gas from a liquefaction train which is either a dual expansion nitrogen cycle liquefaction train, a single mixed refrigerant liquefaction train, a dual mixed refrigerant liquefaction train, or cascade refrigerant.

6. The method of claim 1, further comprising using at least two telescoping mooring arms to engage mooring sockets in a stern of the moveable floating transport vessel to directly connect the stern to the fixed or floating vessel.

7. The method of claim 1, further comprising connecting a docking bar to a stern of the moveable floating transport vessel, then engaging at least two telescoping mooring arms to the docking bar to maintain the moveable floating transport vessel at a nominal distance from the fixed or floating vessel.

8. The method of claim 1, wherein providing connect/disconnect engagements and at least one emergency disconnect engagement between the fixed or floating vessel and the moveable floating transport vessel for fast connect and fast disengagement in case of storms, rogue waves, or a fire is performed using:

a. a primary quick connect/disconnect connector;

b. a secondary emergency disconnect connector; and c. a tertiary emergency disconnect connector.

9. The method of claim 1, further comprising using hydraulic centralizers to maintain the jib in a neutral sliding engagement with the boom.

10. The method of claim 1, further comprising using controllers on the at least one telescoping mooring arm to monitor and control offloading of the fluid to storage tanks on the moveable floating transport vessel, and to monitor and control the flow of the hydrocarbon vapor.

11. The method of claim 10, further comprising communicating from the controllers to a network for allowing client devices of remote users to monitor the loading and offloading of the fluid.

12. The method of claim 11, further comprising using computer instructions to form an executive dashboard of the controllers and offloading data, enabling the remote users to view fixed or floating vessel functions while monitoring offloading and return vapor flow in real time, 24 hours a day, 7 days as week using less than 10 minute updates from the fixed or floating vessel to the remote users.

* * * * *